US011673713B2

(12) United States Patent
Feurer

(10) Patent No.: US 11,673,713 B2
(45) Date of Patent: Jun. 13, 2023

(54) TRANSPORT CONTAINER WITH VARIABLE COMPARTMENT SEPARATION

(71) Applicant: FEURER FEBRA GMBH, Brackenheim (DE)

(72) Inventor: Markus Feurer, Muggensturm (DE)

(73) Assignee: Feurer Febra GmbH, Brackenheim (DE)

( * ) Notice: Subject to any disclaimer, the term of this patent is extended or adjusted under 35 U.S.C. 154(b) by 0 days.

(21) Appl. No.: 17/046,084

(22) PCT Filed: Apr. 2, 2019

(86) PCT No.: PCT/EP2019/058243
§ 371 (c)(1),
(2) Date: Oct. 8, 2020

(87) PCT Pub. No.: WO2019/201584
PCT Pub. Date: Oct. 24, 2019

(65) Prior Publication Data

US 2021/0031979 A1 Feb. 4, 2021

(30) Foreign Application Priority Data

Apr. 18, 2018 (DE) ..... 10 2018 109 176.1

(51) Int. Cl.
*B65D 25/08* (2006.01)
*B65D 1/22* (2006.01)
*B65D 25/06* (2006.01)

(52) U.S. Cl.
CPC ..... *B65D 25/08* (2013.01); *B65D 1/22* (2013.01); *B65D 25/06* (2013.01)

(58) Field of Classification Search
CPC ..... B65D 25/04; B65D 25/02; B65D 2501/24592; B65D 21/0212
See application file for complete search history.

(56) References Cited

U.S. PATENT DOCUMENTS 3,283,943 A * 11/1966 Cargnelutti ..... B65D 21/0212 206/509
3,353,704 A * 11/1967 Belcher ..... B65D 1/243 220/510

(Continued)

FOREIGN PATENT DOCUMENTS

DE 1916934 U 6/1965
DE 9311184 U1 11/1993

(Continued)

OTHER PUBLICATIONS

PCT International Search Report and Written Opinion completed by the ISA/EP dated Jul. 11, 2019 and issued in connection with PCT/EP2019/058243.

(Continued)

*Primary Examiner* — Andrew T Kirsch
(74) *Attorney, Agent, or Firm* — Barnes & Thornburg LLP

(57) ABSTRACT

The invention relates to a transport container (10, 10') with a base (14) and Literal walls (18) which extend from the base (14) to a container upper face (16) and which border a container interior (22) in an annular manner, comprising a separator (24) which is received in the container interior (22) in a removable manner. The separator has interconnected separating walls (26) which extend from the base (14) to the container upper face (16), delimit compartments (28), and are made of a flexible web material. Securing elements (12) for releasably securing to the lateral walls (18) are secured to the separating walls (26). Each of the securing elements (32) has an engagement part (40), and the lateral walls (18) have receiving area interiors (34) which are open at the edge towards the container upper face (16) and in which a respective engagement part of the engagement parts (40) is received.

11 Claims, 7 Drawing Sheets

(56) References Cited

U.S. PATENT DOCUMENTS

Figure 1A:
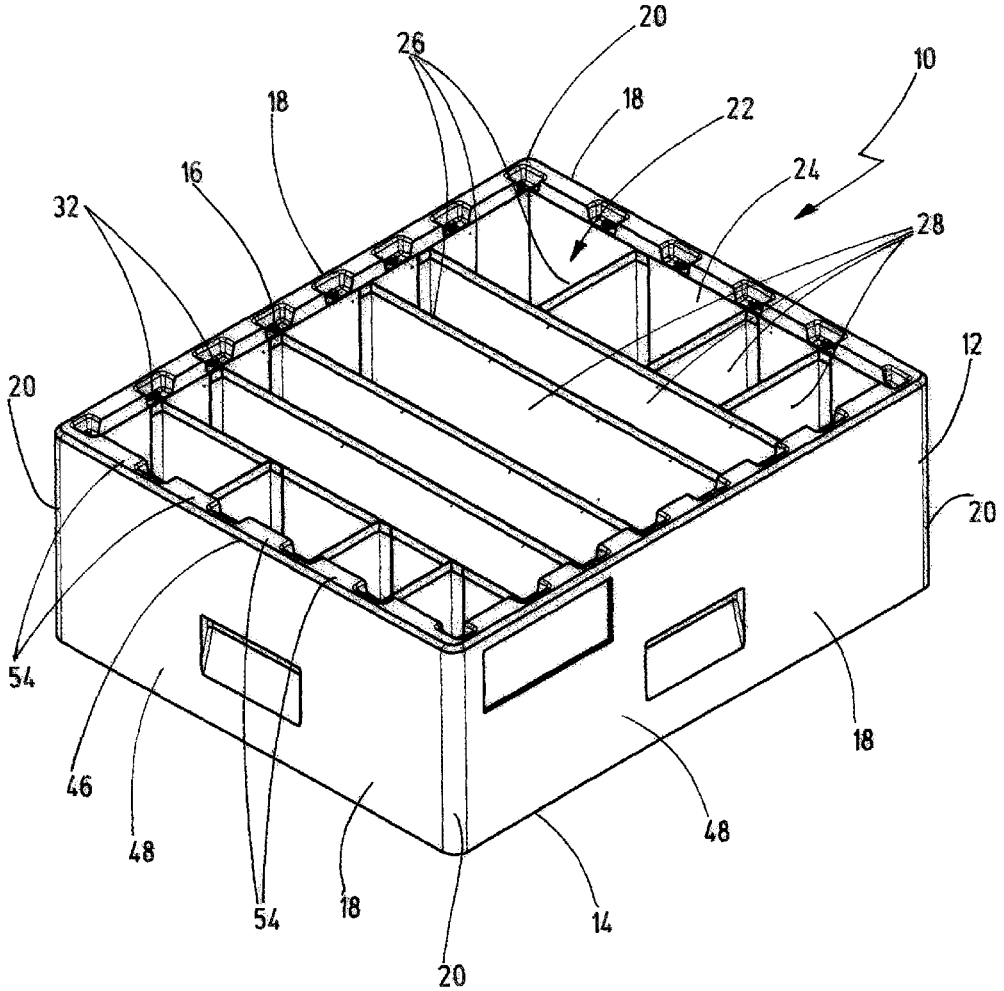
Figure 1B:
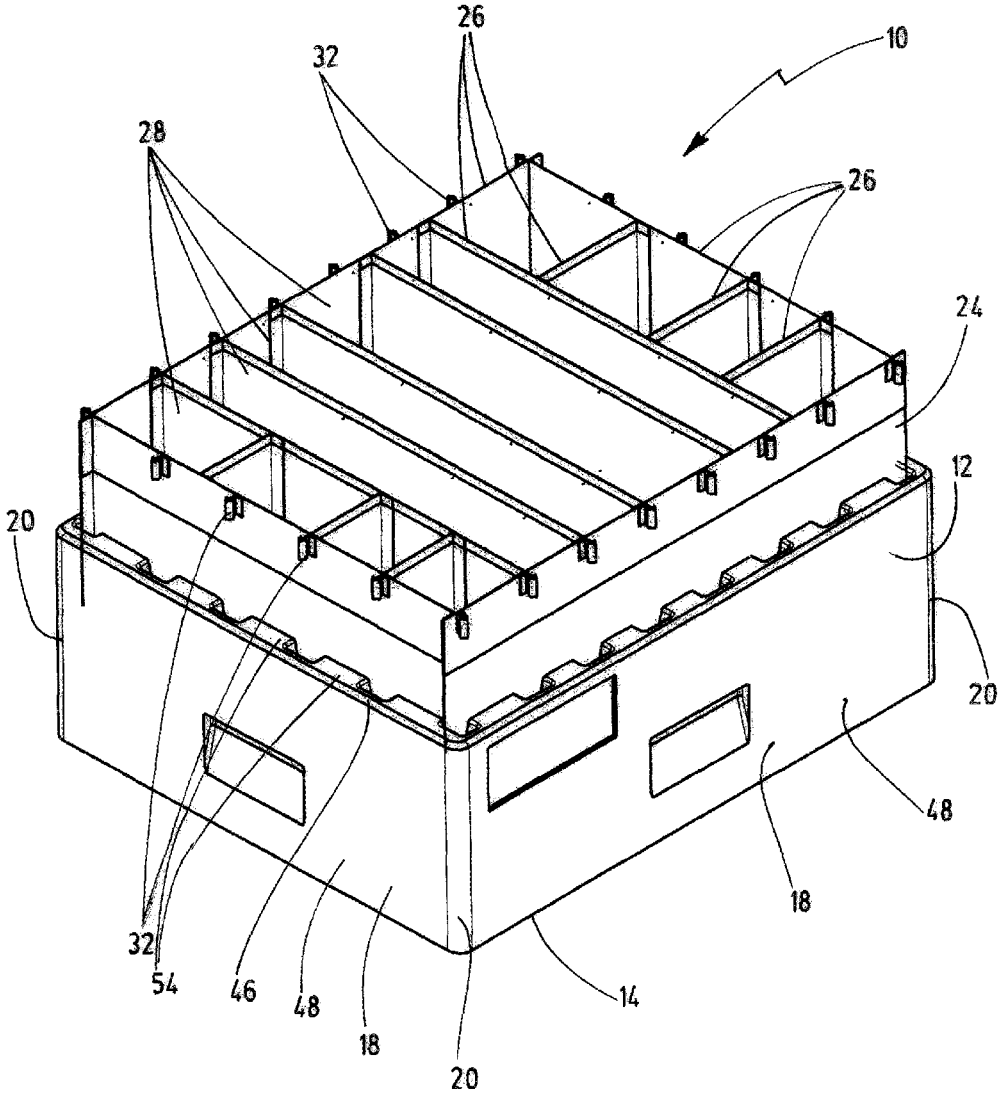
Figure 1C:
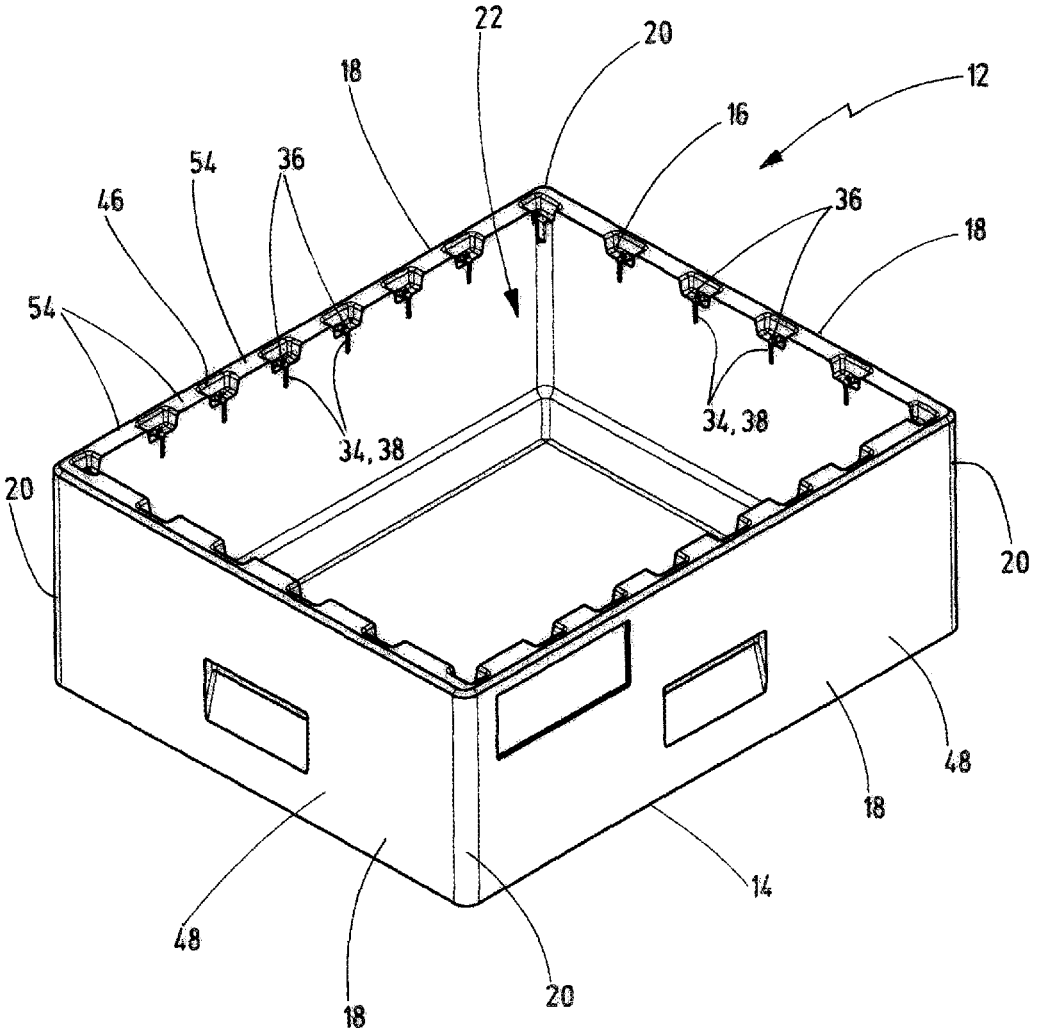
Figure 1D:
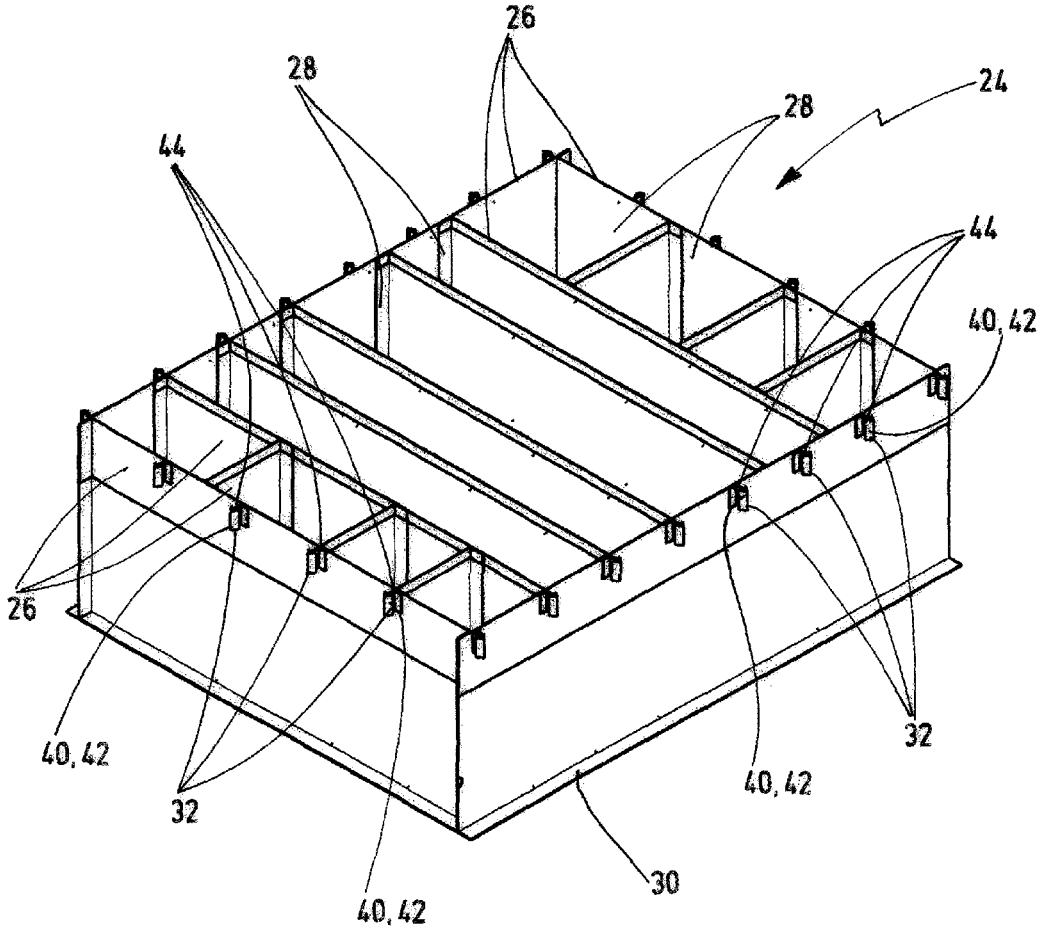

| | | | | |
|---|---|---|---|---|
| 4,093,101 | A * | 6/1978 | Braun | B65D 1/243 220/223 |
| 9,981,778 | B2 | 5/2018 | Plattner | |
| 2003/0173361 | A1* | 9/2003 | Lee | B65D 25/04 220/23.88 |
| 2006/0037824 | A1* | 2/2006 | Park | A45C 13/03 190/110 |
| 2007/0068952 | A1 | 3/2007 | Leytens | |
| 2014/0124406 | A1 | 5/2014 | Ishikawa et al. | |
| 2016/0114970 | A1 | 4/2016 | Bradford | |
| 2016/0325885 | A1 | 11/2016 | Plattner | |

FOREIGN PATENT DOCUMENTS

| | | | |
|---|---|---|---|
| DE | 4433680 | A1 | 3/1996 |
| DE | 19711747 | A1 | 9/1998 |
| DE | 20305956 | U1 | 7/2003 |
| DE | 10347279 | A1 | 5/2005 |
| DE | 202004020524 | U1 | 9/2005 |
| DE | 202005018712 | U1 | 1/2006 |
| DE | 102007004046 | A1 | 7/2008 |
| DE | 102008039461 | A1 | 3/2010 |
| FR | 2303722 | A1 | 10/1976 |
| WO | 2015/107438 | A1 | 7/2015 |

OTHER PUBLICATIONS

Official Action issued in connection with German priority application No. 102018109176.1 dated Jan. 7, 2019.

PCT International Preliminary Report on Patentability, Translation dated Oct. 29, 2020, original Report dated Jul. 19, 2019 for PCT/EP2019/058243.

* cited by examiner

TRANSPORT CONTAINER WITH VARIABLE COMPARTMENT SEPARATION

CROSS-REFERENCE TO RELATED APPLICATIONS

This is a national stage entry of International Patent Application No. PCT/EP2019/058243, filed Apr. 2, 2019, which claims the benefit of and priority to German Patent Application No. 10 2018 109 176.1, filed Apr. 18, 2018, the disclosures of which are incorporated herein by references in their entireties.

The invention relates to a transport container according to the preamble of claim 1.

Such a transport container is known, for example, from DE 10 2008 039 461 A1. It has a base and side walls which extend from the base up to an upper side of the container and border a container interior. A divider is arranged in the container interior in a removable manner and has interconnected partition walls which extend from the base to the upper side of the container and delimit compartments, which serve to accommodate articles and are open in the direction of the upper side of the container. The articles which are to be accommodated can be positioned in the compartments from the upper side of the container and are then separated, by the partition walls, from the articles located in the other accommodating compartments such that the articles cannot come into contact with one another. The divider is provided with hook fasteners which are sewn on the partition walls, whereas the side walls and the base are provided with loop fasteners, and therefore the divider can be fastened on the base and the side walls in a releasable manner. The loop fasteners are adhesively bonded to the side walls and/or the base, although the adhesive-bonding process is difficult and dependent on environmental influences. In addition, DE 20 2005 018 712 U1 discloses a transport container having a divider which is fastened in a removable manner on rails fastened on the inner side of a side wall.

It is therefore the object of the invention to develop a transport container of the type mentioned in the introduction such that said transport container is easier to produce.

This object is achieved according to the invention by a transport container having the features of claim 1. Advantageous developments of the invention form the subject matter of the dependent claims.

The invention is based on the concept of providing, within the side walls, accommodating channels which run preferably vertically in the direction of the base, are open toward the upper side of the container and in which fastening elements, which are fastened on the partition walls, engage, in particular in a form-fitting manner, by way of their engagement portions. It is possible for the base and the side walls here to be formed in one or more pieces and to be produced from various materials, for example from particle foam or hard plastic material. The accommodating channels are introduced in one piece into the side walls while the latter are being produced, and therefore form, within the side walls, cavities which have their peripheries open at least toward the upper side of the container, in which case there is no need for the fastening elements, which are fastened on the partition walls, to have any additional counterparts, fitted on the side walls or on the base, which consist possibly of a different material to that of the side walls and the base and therefore must be problematic to fasten. The fastening elements here are expediently sewn on the partition walls, which consist of a flexible and preferably foldable web material, in particular of textile synthetic fiber material, textile natural fiber material, PVC, plastic sheet material or tarpaulin material made of different constituent parts, and are preferably sewn to one another to form the divider.

The accommodating channels are open in the upper side of the container. The engagement portions can therefore be pushed into the accommodating channels from the upper side of the container. It is preferred here if the accommodating channels extend downward from the upper side of the container. In order for it to be possible to fasten the divider to better effect on the side walls, each of the side walls advantageously has a plurality of open-periphery accommodating channels. In addition, it is possible, on the upper side of the container, for an at least partially encircling stacking periphery to project upward from the side walls and to be complementary to a contour on the underside of the base, said underside being directed away from the container interior. The accommodating channels then open out into the upper side of the container expediently on that side of the stacking periphery which is directed toward the container interior. This means that a plurality of transport containers can be stacked one upon the other, wherein the container interior of one transport container is covered by the next transport container up. The stacking periphery prevents the upper transport container from slipping in relation to the lower transport container. If the upper transport container is covering the mouth openings of the accommodating channels in the upper side of the container, the engagement portions accommodated in the accommodating channels cannot slip out of the same, and therefore the divider is accommodated securely in the transport container. This also applies to the stacking of a plurality of transport containers which do not have a stacking periphery. In addition, provision can be made so that, at a distance from the upper side of the container, the stacking periphery projects into the upper side of the container some way beyond the mouth openings of the accommodating channels. This measure makes it difficult for the engagement elements to be pulled unintentionally out of the mouth openings at the accommodating channels even when these are not covered by a further transport container. According to an advantageous development, teeth project from the stacking periphery in the direction of the container interior, said teeth being spaced apart from one another and being arranged preferably between the mouth openings of the accommodating channels in the upper side of the container, and the underside of the base has apertures which are complementary to the teeth. This measure, as a result of teeth and apertures interengaging when transport containers are stacked one upon the other, achieves further-improved stability of a container stack since slipping of the transport containers stacked one upon the other is prevented not just by the encircling stacking periphery, but also by the interengagement of the teeth and the apertures. The teeth and the stacking periphery, in addition, stabilise each other since they are connected to one another expediently in a fixed manner and preferably in one piece. The stacking periphery, in addition, has a sealing action and prevents liquid or dirt from penetrating laterally when a plurality of transport containers are stacked one upon the other. The stacking periphery can be provided with an encircling chamfer, which forms an encircling surface which slopes up from its outer surfaces in the direction of the accommodating space, and therefore it acts like a drip edge for liquid, for example rainwater, which runs off on the outer surface of a container stack.

It is further possible for the accommodating channels to be open toward the container interior. The engagement portions here expediently have a cross section which is greater than the width of the openings of the accommodating channels toward the container interior, and therefore the engagement portions cannot slip out of the accommodating channels through the openings. It is possible here for the engagement portions to be pushed into the accommodating channels from above, since the latter are additionally open toward the upper side of the container. According to a preferred embodiment, the engagement portions then each form a rigid, first part of the relevant fastening element, said first part being accommodated in the associated accommodating channel, and a second part of the fastening element, said second part being connected to the first part and the partition walls in a fixed manner, projects out of the channel opening. In particular, it is possible for the first part to be in the form of a cylindrical keder and for the second part to be in the form of a keder flag.

However, it is also an option that the engagement portions can be deformed elastically in order for their cross section to be reduced. This allows the engagement portions to be pushed into the accommodating channels, through the openings, from the container interior. According to a further preferred embodiment, the engagement portions then have an arrow-shaped cross section, and their free edges butt against inner surfaces of the accommodating channels and extend on either side from the openings of the accommodating channels. The free edges then act like barbs, which use force to counteract the engagement portions being pulled out of the accommodating channels through the openings thereof.

The invention will be explained in more detail hereinbelow with reference to two exemplary embodiments which are illustrated schematically in the drawing, in which:

FIGS. 1*a* to *d* show a perspective view of a first exemplary embodiment of a transport container, the transport container with a divider partially pulled out, the transport container with the divider removed, and also the divider of the transport container, and FIGS. 2*a* to *d* show detail-type illustrations of a second exemplary embodiment of a transport container.

The transport container 10 illustrated in the drawing has a container part 12, which in the present exemplary embodiments is manufactured in one piece from a particle foam. The container part 12 has a base 14 and side walls 18 which extend upward from the base 14 to an upper side 16 of the container, are connected to one another along four container edges 20 and surround a container interior 22, which is open in the direction of the upper side 16 of the container. The container interior 22 accommodates a divider 24, which has a plurality of partition walls 26 made of a foldable web material. The partition walls 26 are sewn to one another and delimit compartments 28 for accommodating articles, said compartments being open in the direction of the upper side 16 of the container. The divider 24 additionally has a base wall 30, which is formed from the same material as the partition walls 26 and closes the compartments 28 in the downward direction.

The divider 24 is fastened on the container part 12 by means of fastening elements 32. For this purpose, the side walls 18 contain in each case a plurality of accommodating channels 34, which are formed in the side walls 18, each extend some way vertically from a mouth opening 36 in the upper side 16 of the container in the direction of the base 14 and are open in relation to an opening 38 on the inner sides of the relevant side wall 18, said inner sides being directed toward the container interior 22. For the releasable fastening of the divider 24 in the container part 12, the fastening elements 32 each have an engagement portion 40, which engages in one of the accommodating channels 34. In the case of the first exemplary embodiment, the engagement portions 40 each have a first part in the form of a keder 42, which is accommodated in the respective accommodating channel 34, and a second part in the form of a keder flag 44, which projects out of the relevant opening 38 and is fixedly sewn on one of the partition walls 26. The keder 42 here is cylindrical with a cross section which is greater than the width of the openings 38 as measured in the horizontal direction, in which case they cannot slip out of the accommodating channels 34 through the openings 38.

The container part 12 also has an encircling stacking periphery 46 projecting upwardly from the upper side of the container 16, which is aligned externally with the outer sides 48 of the side walls 18, but is offset outward in relation to the container interior 22 and thus also encircles the mouth openings 36 externally. Accordingly, the base 14 has, on its underside 50, a contour 52 which is complementary to the stacking periphery 46. Teeth 54 project from the stacking periphery 46 in the direction of the container interior 22, said teeth being spaced apart from one another and being arranged between the mouth openings 36 and extending from the upper side 16 of the container to the same height as the stacking periphery 46, whereas, the base 14, in its underside 50, has apertures which are complementary to the teeth 54, but are not illustrated specifically in the drawing. A plurality of identical transport containers 10 can be stacked in this way one above the other by virtue of the stacking periphery 46 engaging in a form-fitting manner in the contour 52 of the next transport container 10 up, and by virtue of the teeth 54 engaging in a form-fitting manner in the apertures of the next transport container 10 up. The mouth openings 36 are then covered, and closed, by the base 14 of the next transport container 10 up, and therefore the engagement portions 40 cannot slip out of the accommodating channels 34.

The transport container 10' according to the second exemplary embodiment differs from the transport container 10 according to the first exemplary embodiment merely in the shape of the engagement portions 40 and of the accommodating channels 34. Like features are therefore provided with like reference signs.

The engagement portions 40 according to the second exemplary embodiment have an arrow shape with a central rib 56, from which two transverse ribs 58 project at an acute angle, in the direction of the container interior 22, on sides which are directed away from one another. The central rib 56 is adjoined by an extension 60, which projects out of the accommodating channel 34, through the respective opening 38, and is connected to one of the partition walls 26 in a fixed manner. The transverse ribs 58 butt against inner surfaces 64 of the accommodating channels 34 by way of their free edges 62, wherein, in each case on either side of the openings 38, one of the inner surfaces 64 extends away from the opening 38. The engagement portions 40 according to the second exemplary embodiment can be introduced into the accommodating channels 64 through the openings 38 by virtue of the transverse ribs 58 being bent elastically until their free edges 62 butt against the central rib 56. When the accommodating channel 34 is reached, the transverse ribs 58 spread apart again, and therefore, by virtue of butting against the inner surfaces 64, their free edges 62 act like barbs, which prevent the engagement portions from being pulled out of the accommodating channel 34.

Figure 2A:
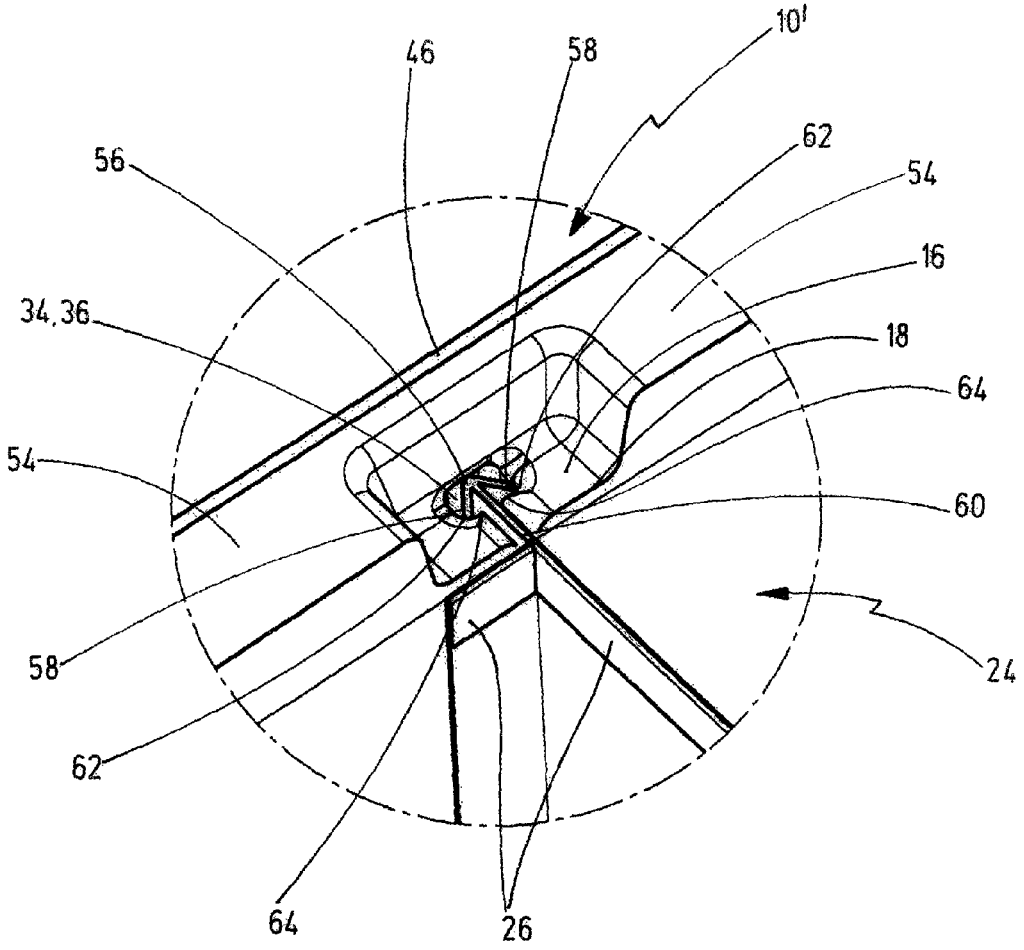
Figure 2B:
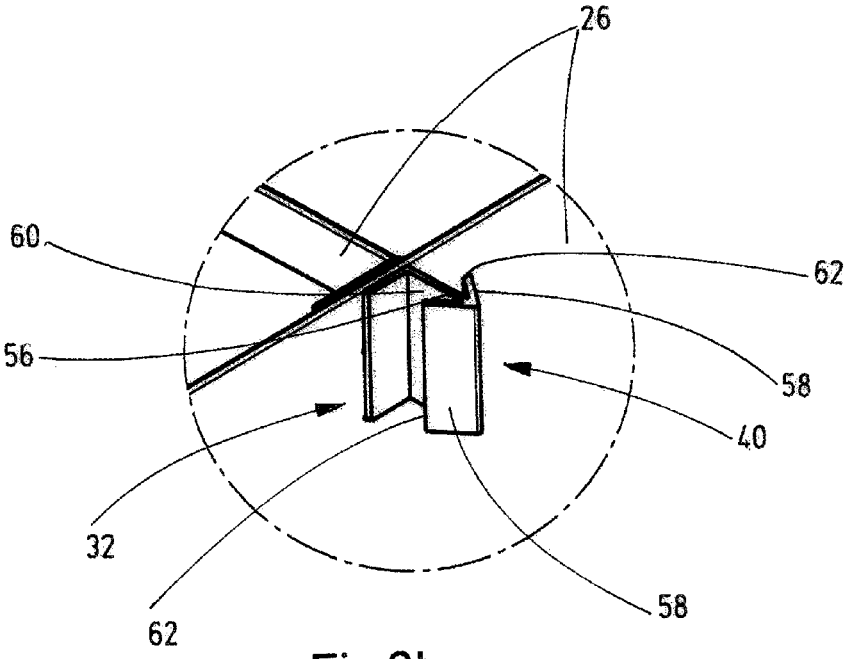
Figure 2C:
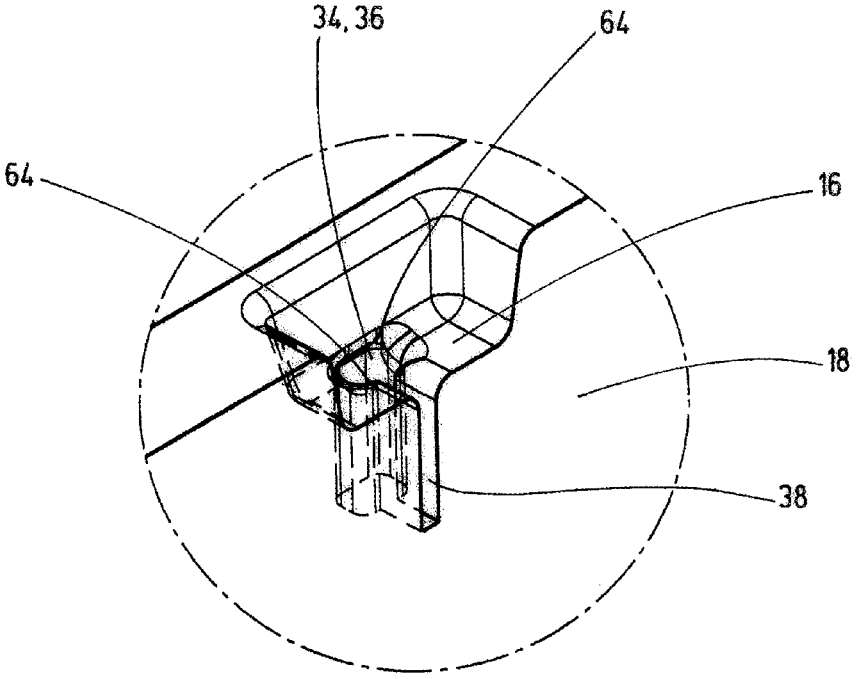
Figure 2D:
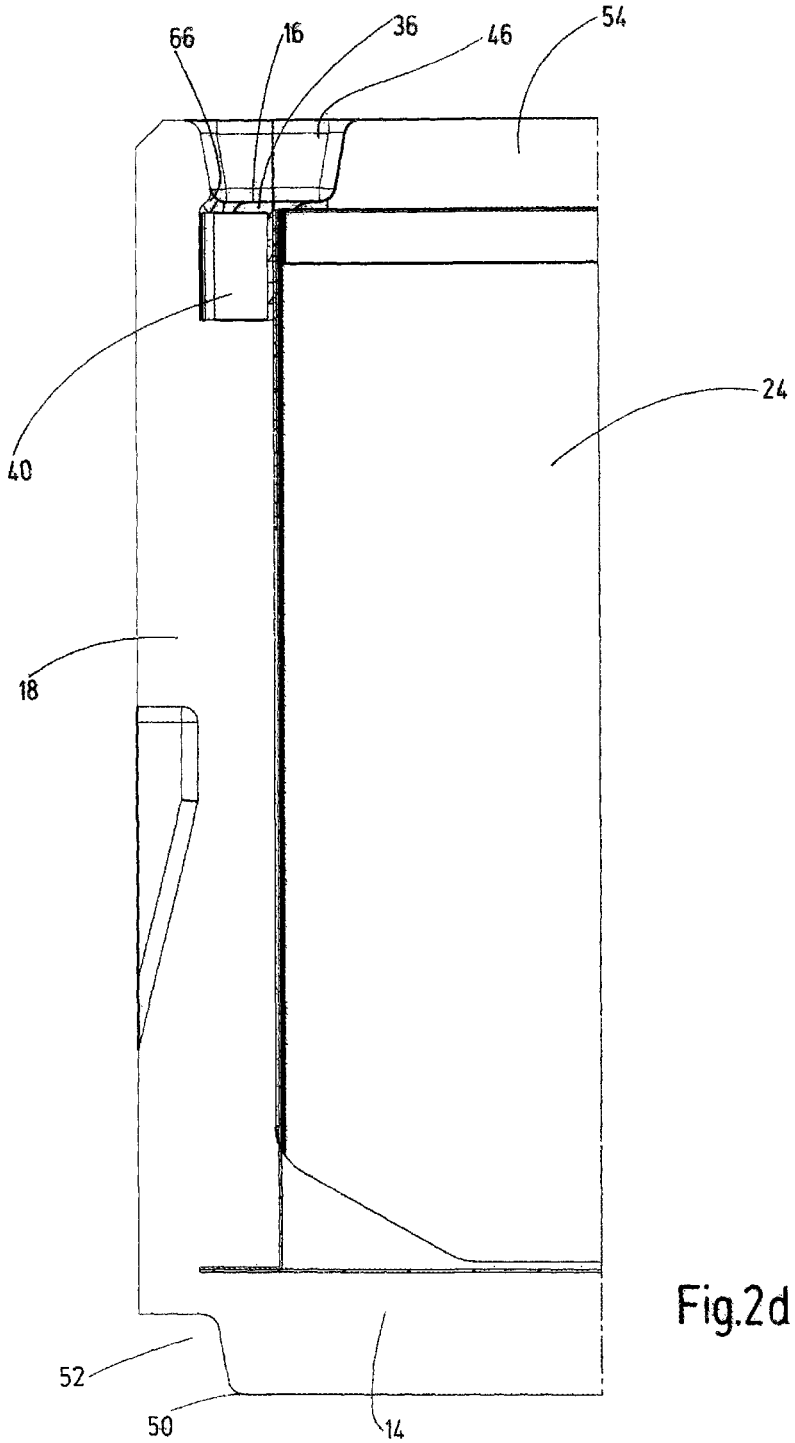

In the case of the second exemplary embodiment, as in the case of the first exemplary embodiment, the stacking periphery 46 is arranged such that, at a distance above the upper side 16 of the container it projects some way beyond the mouth openings 36, as illustrated by way of example in FIG. 2*d*. In this region, the stacking periphery 46 forms a slope 66 and counteracts any pulling of the respective engagement portion 40 out of the accommodating channel 34 with a resistance, which prevents unintentional slipping-out action.

To summarize: the invention relates to a transport container 10, 10' having a base 14, having side walls 18 which extend from the base 14 up to an upper side 16 of the container and border a container interior 22, and having a divider 24 which is accommodated in the container interior 22 in a removable manner and has interconnected partition walls 26 which are made of a flexible web material, extend at least some way between the base 14 and the upper side 16 of the container and delimit compartments 28 which are open toward the upper side 16 of the container, and also has fastening elements 32 which are fastened on the partition walls 26 and are intended for releasable fastening on the side walls 18. The invention makes provision for the fastening elements 32 each to have an engagement portion 40, and for the side walls 18 to have open-periphery accommodating channels 34, in which in each case one of the engagement portions 40 is accommodated and which are open toward the upper side 16 of the container.

The invention claimed is:

1. A transport container comprising:

a base, side walls which extend from the base up to an upper side of the container and border a container interior, a divider which is accommodated in the container interior in a removable manner and has interconnected partition walls which are made of a flexible web material, and which extend at least some way between the base and the upper side of the container and delimit compartments which are open toward the upper side of the container, and fastening elements which are fastened on the partition walls and are configured for releasable fastening on the side walls, wherein the fastening elements each have an engagement portion, and wherein the side walls have mouth openings formed in and along the upper side of the container defined by the side walls, the mouth openings open to the upper side of the container, and wherein the side walls have open-periphery accommodating channels formed therein, in which in each case one of the engagement portions is accommodated and which extend from a respective one of the mouth openings downwardly in the direction of the base, and wherein a stacking periphery projects upwardly from the upper side of the container, the stacking periphery being aligned externally with the outer sides of the side walls and encircling the mouth openings, and wherein an underside of the base defines a contour complementary to the stacking periphery to provide for stacking of plural transport containers on top of one another with the stacking periphery of one transport container configured to engage in a form-fitting manner with the contour formed in the underside of the base of another transport container such that the base of the another transport container adjacent to the contour covers and closes the mouth openings of the one transport container so as to prevent the engagement portions from slipping out of the open-periphery accommodating channels of the one transport container, and wherein the open-periphery accommodating channels are open via openings toward the container interior, and wherein the engagement portions have a cross section which is greater than the width of the openings of the open-periphery accommodating channels toward the container interior, and wherein the engagement portions are configured to be deformed elastically in order for their cross section to be reduced so as to be introduced into the open-periphery accommodating channels via the openings of the open-periphery accommodating channels.

2. The transport container as claimed in claim 1, wherein each of the side walls has a plurality of the open-periphery accommodating channels.

3. The transport container as claimed in claim 1, wherein the open-periphery accommodating channels are located in the side walls.

4. The transport container as claimed in claim 1, wherein the fastening elements are sewn on the partition walls.

5. The transport container as claimed in claim 1, wherein, at a distance from the upper side of the container, the stacking periphery projects into the upper side of the container beyond the mouth openings of the open-periphery accommodating channels.

6. The transport container as claimed in claim 1, wherein teeth project from the stacking periphery in the direction of the container interior, said teeth being spaced apart from one another and being arranged between the mouth openings of the open-periphery accommodating channels in the upper side of the container, and in that the underside of the base has apertures which are complementary to the teeth.

7. The transport container as claimed in claim 1, wherein the engagement portions have an arrow-shaped cross section, and wherein free edges of the engagement portions butt against inner surfaces of the open-periphery accommodating channels which surfaces extend from the openings of the open-periphery accommodating channels toward the container interior.

8. The transport container as claimed in claim 1, wherein the partition walls comprise a textile synthetic fiber material, textile natural fiber material, PVC, plastic sheet material or tarpaulin material.

9. The transport container as claimed in claim 8, wherein the partition walls are sewn to one another to form the divider.

10. The transport container as claimed in claim 1, wherein the base and the side walls form a container part which is formed in one piece from a particle foam.

11. The transport container as claimed in claim 10, wherein the particle foam comprises expanded polypropylene (EPP) or expanded polyurethane (EPU).

* * * * *